US011761246B2

(12) United States Patent
Griswold et al.

(10) Patent No.: US 11,761,246 B2
(45) Date of Patent: Sep. 19, 2023

(54) SURFACE VERTICAL ROD EXIT DEVICE

(71) Applicant: Sargent Manufacturing Company, New Haven, CT (US)

(72) Inventors: Lee Griswold, Bethel, CT (US); Ryan Piantek, Higganum, CT (US)

(73) Assignee: Sargent Manufacturing Company, New Haven, CT (US)

( * ) Notice: Subject to any disclaimer, the term of this patent is extended or adjusted under 35 U.S.C. 154(b) by 479 days.

(21) Appl. No.: 16/732,752

(22) Filed: Jan. 2, 2020

(65) Prior Publication Data

US 2020/0386011 A1 Dec. 10, 2020

Related U.S. Application Data

(60) Provisional application No. 62/857,696, filed on Jun. 5, 2019.

(51) Int. Cl.

| | |
|---|---|
| ***E05B 65/10*** | (2006.01) |
| ***E05C 9/00*** | (2006.01) |
| ***E05C 9/22*** | (2006.01) |

(52) U.S. Cl.

CPC ..... *E05B 65/1006* (2013.01); *E05C 9/006* (2013.01); *E05C 9/22* (2013.01); *E05Y 2900/132* (2013.01)

(58) Field of Classification Search

CPC .. E05B 65/1006; E05B 65/10; E05B 65/1046; E05B 65/1053; E05C 9/006;

(Continued)

(56) References Cited

U.S. PATENT DOCUMENTS 430,032 A * 6/1890 Kaiser ..... E05B 83/36 49/503
3,776,582 A * 12/1973 Balducci ..... E05B 65/1006 292/216

(Continued)

FOREIGN PATENT DOCUMENTS

DE 2642074 A1 * 3/1978 ..... E05C 9/08
DE 19709492 A1 * 9/1998 ..... E05C 9/004

(Continued)

OTHER PUBLICATIONS

Espacenet machine translation FR 2861789A1, May 2005 (Year: 2023).*

(Continued)

*Primary Examiner* — Kristina R Fulton
*Assistant Examiner* — Steven A Tullia
(74) *Attorney, Agent, or Firm* — Wolf, Greenfield & Sacks, P.C.

(57) ABSTRACT

A door exit device may include an actuator, an upper latch, and a lower latch. The actuator may be operatively coupled to the upper latch by a first drive and to the lower latch by a second drive. Each drive may include a housing which is mountable to the exterior of a door panel and a drive rod slidably supported within the housing. The housing may include a base which is mountable to the door panel and a cover attachable to the base with the drive rod located between the base and the cover. The housing may be configured to extend from the actuator to the latch to conceal the entire length of the rod between the actuator and the latch.

20 Claims, 4 Drawing Sheets

(58) Field of Classification Search
CPC ..... E05C 9/22; E05Y 2900/132; Y10T 292/0908; Y10T 292/0909; Y10T 292/091; Y10T 292/0848; Y10T 292/086; Y10S 292/65; Y10S 292/53; Y10S 292/54
USPC ..... 49/503
See application file for complete search history.

(56) References Cited

U.S. PATENT DOCUMENTS

| | | | | | |
|---|---|---|---|---|---|
| 4,690,442 | A * | 9/1987 | Reynard | E05C 9/22 | 292/DIG. 32 |
| 5,016,393 | A * | 5/1991 | Weinerman | E05C 9/22 | 49/495.1 |
| 5,042,852 | A * | 8/1991 | Vitt | E05B 65/1046 | 49/141 |
| 6,807,774 | B1 * | 10/2004 | Nottingham | B61D 19/009 | 292/DIG. 32 |
| 2008/0169655 | A1 * | 7/2008 | Gomez Gonzalez | E05B 15/102 | 292/81 |
| 2017/0081882 | A1 * | 3/2017 | Lin | E05B 65/1006 | |

FOREIGN PATENT DOCUMENTS

| | | | | | |
|---|---|---|---|---|---|
| DE | 19828267 | A1 * | 12/1999 | E05C 9/004 | |
| DE | 19859546 | A1 * | 7/2000 | E05C 9/006 | |
| DE | 202008005453 | U1 * | 8/2008 | E05C 9/22 | |
| EP | 721041 | A1 * | 7/1996 | E05C 9/004 | |
| EP | 0916791 | A2 * | 5/1999 | E05C 9/22 | |
| FR | 1067271 | A * | 6/1954 | E05C 9/041 | |
| FR | 1260826 | A * | 4/1960 | E05C 9/22 | |
| FR | 1282044 | A * | 12/1960 | E05C 9/22 | |
| FR | 1570029 | A * | 4/1968 | E05C 9/006 | |
| FR | 2861789 | A1 * | 5/2005 | E05B 63/04 | |
| FR | 2938866 | A1 * | 5/2010 | E05C 9/006 | |
| GB | 2097467 | A * | 11/1982 | E05C 9/006 | |

OTHER PUBLICATIONS

Espacenet machine translation FR 1067271 A, Jun. 1954 (Year: 2023).*
Espacenet machine translation EP 0916791 A, May 1999 (Year: 2023).*

* cited by examiner

SURFACE VERTICAL ROD EXIT DEVICE

RELATED APPLICATIONS

This application claims the benefit under 35 U.S.C. § 119(e) to U.S. Provisional Application No. 62/857,696, filed Jun. 5, 2019, which is incorporated by reference herein in its entirety.

FIELD

Disclosed embodiments are related to a surface vertical rod exit device.

BACKGROUND

Vertical rod exit devices are traditionally used to secure a door at multiple latching points. Conventionally, such devices are used to secure doors along the floor or threshold and the header or transom of the door, and optionally along the jamb. Depending on the particular application, the vertical rods may be concealed inside the door or attached to an exterior surface of the door.

SUMMARY

In one embodiment, a door exit device comprises at least one latch configured to be mounted to a door panel, an actuator configured to be mounted to the door panel and at least one drive. The at least one latch includes a latch head movable between an engaged position and a disengaged position, the latch head configured to engage a strike plate in the engaged position. The actuator is configured to convert an actuation force applied thereto into a drive force to move the latch head in response to application of the actuation force. The at least one drive is configured to operatively couple the actuator to the at least one latch. The at least one drive includes an elongated housing and an elongated rod. The housing is configured to be mounted to an exterior surface the door panel and to slidably support the rod therein. The housing includes a first end and a second end and has a length sufficient to position the first end at the actuator and to position the second end at the at least one latch. The rod is configured to deliver the drive force from the actuator to the at least one latch. The rod includes a first end configured to be coupled to the actuator and a second end configured to be coupled to the at least one latch.

In another embodiment, a door comprises a door panel including a top end and a bottom end, and a surface vertical rod exit device mounted to the door panel. The surface vertical rod exit device includes an upper latch mounted to the door panel in proximity to the top end thereof, a lower latch mounted to the door panel in proximity to the bottom end thereof, and an actuator mounted to the door panel between the upper latch and the lower latch. The upper latch includes an upper latch head movable between an engaged position and a disengaged position, with the upper latch head configured to engage an upper strike plate in the engaged position. The lower latch includes a lower latch head movable between an engaged position and a disengaged position, with the lower latch head configured to engage a lower strike plate in the engaged position. The actuator is operative to move the upper latch head and the lower latch head in response to an actuation force being applied to the actuator, with the actuator configured to convert the actuation force into a first drive force and a second drive force. The surface vertical rod exit device further includes a first drive coupling the actuator to the upper latch, and a second drive coupling the actuator to the lower latch. The first drive includes a first housing and a first rod movably housed within the first housing, with the first housing mounted to an exterior surface of the door panel and extending from the actuator to the upper latch. The first rod couples the actuator to the upper latch and is configured to transmit the first drive force from the actuator to the upper latch. The second drive includes a second housing and a second rod movably housed within the second housing, with the second housing mounted to the exterior surface of the door panel and extending from the actuator to the lower latch. The second rod couples the actuator to the lower latch and is configured to transmit the second drive force from the actuator to the lower latch.

In another embodiment, a surface vertical rod kit is provided for a door surface vertical rod exit device which includes an actuator and at least one latch. The surface vertical rod kit comprises an elongated base configured to be mounted to an exterior surface of a door panel, an elongated rod having a rectangular cross-sectional shape configured to be slidably supported by the base, and a cover configured to enclose the base with the rod located therebetween. The elongated rod has a length sufficient to extend from a location of the door panel at or in close proximity to the actuator to a location of the door panel at or in close proximity to the at least one latch. The rod is configured to transmit at least a portion of an actuation force from the actuator to the at least one latch.

In a further embodiment, a method is provided for installing a surface vertical rod of a door exit device. The method comprises acts of: (a) mounting an elongated base to an exterior surface of a door panel; (b) slidably supporting an elongated rod on the base, the rod configured to transmit at least a portion of an actuation force from an actuator to at least one latch; and (c) enclosing the base and the rod with an elongated cover to conceal the length of the rod extending from the actuator to the at least one latch.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
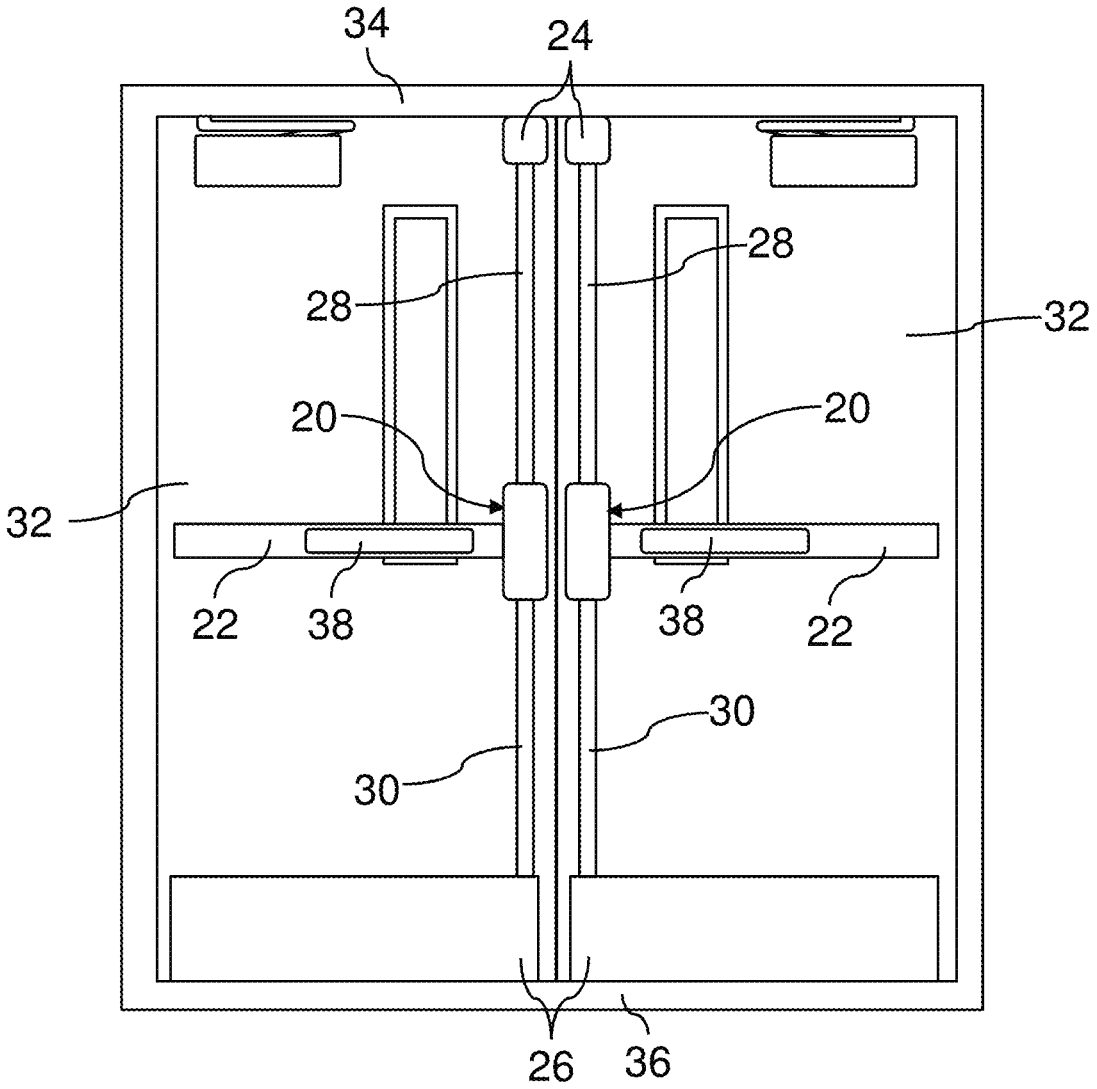
FIG. 1 is a front view of a pair of door panels including a door exit device according to one embodiment.

Multi-point latching exit devices may be employed with doors to provide additional security and/or strength. Such door exit devices may employ vertical rods or tethers linked to a common actuator which permits a user to operate multiple latches with the same actuator. The vertical rods may be attached to the exterior surface of a door (surface vertical rod exit device), or may be located and concealed inside the door (concealed vertical rod exit device). Typically, door exit devices include a top or transom latch and a bottom or floor latch providing two-point fastening for the door. For some applications, the lock device may also include a side or jamb latch providing a three-point fastening for the door.

Concealed vertical rod exit devices may be employed for applications where security and/or aesthetics may be important considerations. For example, vertical rods concealed within a door may help prevent vandals from removing the rods from a door and/or manipulating a door exit device using the rods. Concealed surface rods may also be less obtrusive and more aesthetically pleasing. Concealed vertical rod exit devices are generally used on new door installations which have been designed specifically to accommodate the device. However, concealed vertical rods may be relatively difficult to install, replace and/or service. In cases where the exit device is at least partially concealed within a door, maintenance or repairs of the latches with degraded performance may be expensive and time consuming. Additionally, installation or removal of the latches concealed in the door typically require removal of the door panel which is time consuming and labor intensive.

Surface vertical rod (SVR) exit devices may be employed for applications where security and/or aesthetics may be of less concern. SVR devices tend to provide particular advantages associated with installation, servicing, and/or retrofitting existing doors. SVR exit devices may also be suitable when it is desired to use a solid door panel. However, the vertical rods of the device tend to be more obtrusive and have less aesthetic appeal. Because surface vertical rods are typically mounted in a spaced relation to the surface of the door, there may also be concerns about vandals potentially prying the rods from a door and/or manipulating a door exit device using the rods.

In view of the above, the inventors have recognized the benefits of a door exit device including one or more drives having surface vertical rods which are supported within one or more elongated housings mountable to an exterior surface of a door panel. The housing may be configured to conceal the rod from view in an aesthetically pleasing manner. The housing may have a relatively low profile configuration which may facilitate blending the drive with the surface of the door panel. The housing may also be configured to prevent direct access to the rod so as to reduce the potential for unwanted rod removal and/or manipulation.

In some embodiments, a door exit device may include an actuator, an upper latch, and a lower latch. The actuator may be operatively coupled to the upper latch and the lower latch so that the upper latch and the lower latch may be operated concurrently by a single actuation of the actuator. Accordingly, in some embodiments, the actuator may be connected to the upper latch by a first (i.e., upper) drive and connected to the lower latch by a second (i.e., lower) drive. The first drive and the second drive may be configured to move substantially linearly along a common axis. However, if desired, the drives may be configured to move along a first axis and a second axis, respectively, which may be offset and/or angled relative to each other. Accordingly, when the actuator is actuated by a user, the first drive and the second drive may be moved linearly along their common or respective axes to operate the upper and lower latches.

In some embodiments, each drive may include a housing which is mountable to the exterior of a door panel and a drive rod slidably supported within the housing. The drive rod may be configured to operatively couple and transmit a force from the actuator to the respective latch. This may be accomplished in some embodiments by a cam arrangement in the actuator including a lever, a first cam and a second cam. The first and second cams may be operatively coupled to first and second rods of the first and second drives, respectively, and may be configured to move the first and second rods when the lever is actuated (e.g., rotated). In particular, the lever may engage the first cam to move the first rod in a first direction to operate the upper latch and may engage the second cam to move the second rod in a second direction to operate the lower latch. Thus, according to this embodiment, the upper latch and the lower latch may be operated concurrently by a single actuation of the lever.

In some embodiments, the housing may include a base which is mountable to the door panel and a cover attachable to the base with the drive rod located between the base and the cover. The housing may be configured to extend from the actuator to the latch to conceal the entire length of the rod between the actuator and the latch. In some embodiments, the opposing ends of the housing may extend into the corresponding latch and the actuator to conceal the ends of the housing.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 illustrates a pair of door panels with a door exit device 20 mounted to an exterior surface of each door panel. However, it is to be appreciated that an exit device may be employed with a single door arrangement or other door arrangements as should be apparent to one of skill in the art. Moreover, as described below, a door exit device may include upper and lower latches. However, it is to be understood that a door exit device may include a single latch or more than two latches. For example, and without limitation, a door exit device may include a side latch together with upper and lower latches, a side latch with either an upper or lower latch, or one of an upper or lower latch alone.

In one illustrative embodiment shown in FIG. 1, a door exit device 20 may include an actuator 22, an upper latch 24, and a lower latch 26. A first drive 28 may operatively couple the actuator to the upper latch 24 and a second drive 30 may operatively couple the actuator to the lower latch 26. According to one embodiment, the exit device is configured to be mounted to the exterior surface of a door panel 32. If desired, one or more portions of the exit device may be concealed or partially concealed, as the present disclosure is not so limited.

As shown in FIG. 1, the exit device 20 may be arranged with the first and second drives 28, 30 oriented in a vertical direction. The upper latch 24 may be configured to engage a door transom or header 34 and the lower latch 26 may be configured to engage a door threshold or floor 36. With the upper latch 24 and the lower latch 26 both coupled to the same actuator 22, the upper and lower latches may be actuated concurrently to selectively secure or release a door.

Figure 5:
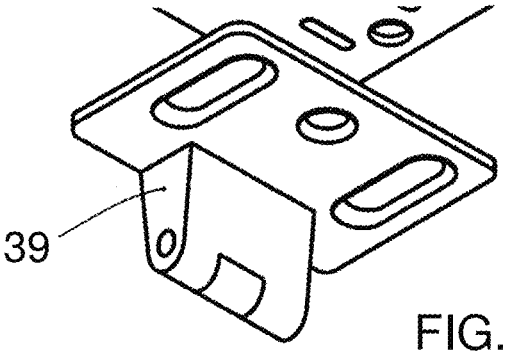
FIG. 5 is perspective view of a strike plate of the door exit device according to one embodiment.
Figure 4:
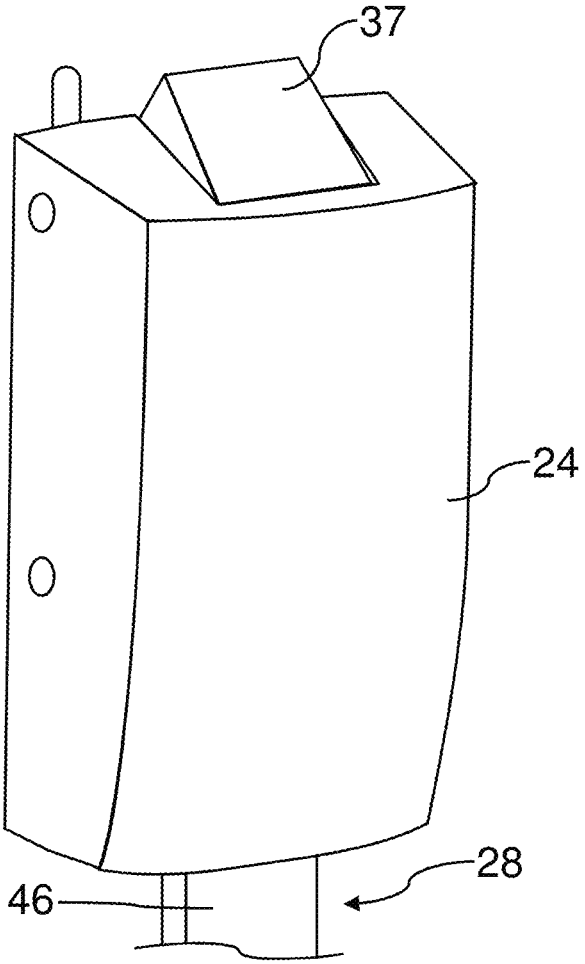
FIG. 4 is perspective view of a latch of the door exit device according to one embodiment.

In one embodiment as illustrated in FIG. 4, each latch may include a latch head 37 which is movable between an extended or engaged position (as shown) for engaging a strike plate to secure a door and a retracted or disengaged position for disengaging the strike plate to unlock the door. FIG. 5 illustrates one embodiment of a strike plate 39 which may be employed with the latch to secure a door. It is to be understood that the latch and/or the strike plate may employ any suitable configuration and/or arrangement as should be apparent to one of skill in the art.

In one embodiment illustrated in FIG. 1, the first and second drives 28, 30 may be positioned along a common vertical axis. However, it is to be appreciated that other drive arrangements may be employed as should be apparent to one of skill in the art. For example, and without limitation, each drive may be positioned along separate vertical axes which are offset from each other. Moreover, the drives may be located along one or more axes which are oriented in a non-vertical direction relative to a vertical hung door panel.

The actuator 22 may include a push bar arrangement, such as is known in the art, for actuating the upper and lower latches 24, 26. In this regard, the actuator may be configured to convert an actuation force applied to a push bar 38 into a drive force which may include a first drive force and a second drive force. In one embodiment illustrated in FIG. 1, the first drive 28 may be configured to transmit the first drive force from the actuator to the upper latch 24 and the second drive 30 may be configured to transmit the second drive force to the lower latch 26.

Figure 2:
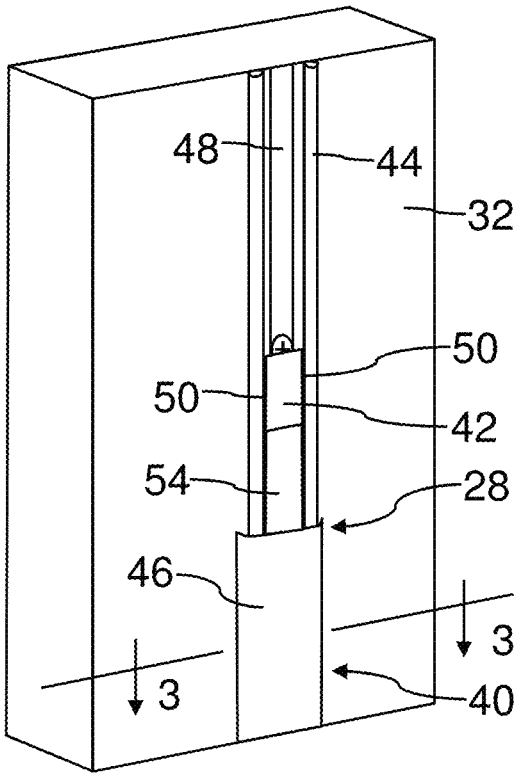
FIG. 2 is a perspective fragmented view of a portion of a drive of the door exit device of FIG. 1.
Figure 3:
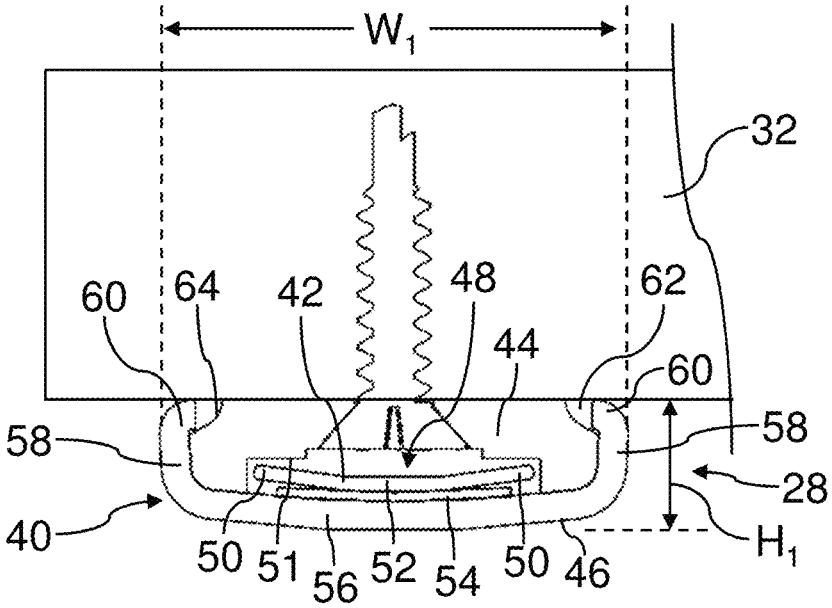
FIG. 3 is a cross-sectional view of the drive of the door exit device taken along section line 3-3 of FIG. 2.

In one illustrative embodiment shown in FIGS. 2-3, each drive 28, 30 may include a housing 40 and a rod 42 movably supported within the housing. As illustrated in FIG. 1, each drive, including the housing 40 and the rod 42, may have an elongated configuration which extends from the actuator 22 to a corresponding latch 24, 26. In this manner, the entire length of the rod may be enclosed and concealed by the housing. In one embodiment, the opposing ends of the housing 40 and the rod 42 may extend into the respective housings for the latches 24, 26 and the actuator 22 to enclose and conceal the ends of the drive.

In one illustrative embodiment shown in FIGS. 2-3, the housing 40 may include a base 44 which is mountable to the surface of a door panel and a cover 46 configured to overlie the base. The rod 42 may be slidably supported between the base 44 and the cover 46. To facilitate sliding movement of the rod within the housing, the base 44 may include a channel 48 configured to receive the rod therein. In one embodiment, the channel 48 may be configured to have a width and a height sufficient to fully receive the rod and prevent binding the rod between the base and the cover while controlling movement of the rod along the base. In one embodiment, the channel 48 may extend along the entire length of the base 44. However, it is to be understood that the channel may employ any suitable configuration, size and/or length as should be apparent to one of skill in the art.

To provide smooth movement of the rod 42 along the base 44 and/or reduce potential misalignment and/or rattling of the rod within the housing, it may be desirable to configure the base 44, the rod 42 and/or the cover 46 to work together and limit movement of the rod relative to the housing. For example, and without limitation, the components may be configured to allow movement of the rod in the longitudinal direction along the length of the housing during actuation while limiting movement of the rod in directions along the width and depth of the channel.

In one illustrative embodiment shown in FIG. 3, the rod 42 and the channel 48 may each have a width which places the opposing longitudinal edges 50 of the rod in close proximity to the sides of the channel to limit side-to-side and/or twisting movement of the rod relative to the base. The rod 42 and the channel 48 may each have a height or thickness which limits, if not eliminates, movement of the rod toward and away from the bottom surface 51 of the channel when the cover is attached to the base. In one embodiment, the rod may be configured so that the opposing edges 50 engage the bottom surface 51 of the channel and a mid-portion 52 of the rod located between the opposing edges is spaced from and urged in a direction toward the bottom of the channel by the cover. In this manner, the rod and the cover may be configured to maintain the opposing edges of the rod in engagement with the bottom surface of the channel.

In one illustrative embodiment as shown in FIG. 3, the rod 42 may have an arcuate configuration, such as an arched, bowed or curved shape, with the mid-portion 52 of the rod being spaced from the bottom of the channel when the opposing edges 50 of the rod engage the bottom of the channel. In one embodiment, the rod may have a concave configuration relative to the bottom of the channel. The rod may have a flexibility or resiliency which allows the mid-portion to be displaced toward the bottom of the channel in response to application of a force to the mid-portion to maintain contact with the base.

In one embodiment, the rod may be configured with a height in a relaxed state which exceeds the height from the bottom of the channel to the inner surface of the cover. Thus, when the cover is attached to the base, the mid-portion 52 of the rod becomes compressed and displaced toward the bottom of the channel by the cover. This in turn causes the opposing edges of the rod to maintain contact with the channel and the mid-portion of the rod to maintain contact with the cover resulting in a relatively tight, smooth operating drive without binding the longitudinal movement of the rod.

To facilitate sliding movement of the rod 42 along the housing 40, a low friction material may be provided between the rod 42 and the cover 46 and/or the rod 42 and the base 44. In one illustrative embodiment shown in FIG. 3, a slide layer 54 of low friction material may be located between the cover and the rod to reduce friction therebetween. The slide layer 54 may be placed and held in contact with the mid-portion 52 of the rod by the cover. In one embodiment, the slide layer may be attached to the cover using any suitable technique including, but not limited to, adhesion, bonding, fastening, or welding, as should be apparent to one of skill in the art.

In one embodiment, the slide layer may be formed from any suitable low friction material as should be apparent to one of skill in the art. For example, and without limitation, the low friction material may include polytetrafluoroethylene (e.g., TEFLON), ultra-high molecular weight polyethylene (UHMW), polyimide, polyetheretherketone (PEEK), nylon, acetal or polyester.

For some applications, it may be desirable to provide one or more slide layers between the rod 42 and the base 44 to reduce friction therebetween. The use of low friction layers may depend on the contact area between the rod and the base and/or the materials used for the rod and the base. For example, and without limitation, employing a curved rod, such as illustrated in FIG. 3, may present a relatively small contact area between the opposing edges 50 of the rod and the base 44 which may result in a relatively small amount of friction and resistance to sliding of the rod along the base. However, should the rod and the base be configured and/or made from materials which can produce an undesirable amount of friction when sliding against each other, a low friction slide layer may be beneficial between the points of contact, particularly should the rod be pressed against the base by the cover.

For some applications, it may be desirable to employ a cover configured to conceal the rod and the base from view and/or access. Such an arrangement may provide an aesthetically pleasing appearance when mounted to a door and/or reduce direct access to the rod and/or the base which could otherwise result in unauthorized removal and/or manipulation of the rod.

In one illustrative embodiment shown in FIG. 3, the cover 46 may include a top wall 56 to overlie the rod 42 and the base 44 and a pair of side walls 58 extending from the edges of the top wall and along the sides of the base. A lip 60 may be provided at the end of each side wall to engage the base and secure the cover to the base. As shown, the base 44 may include a recess 62, such as an undercut, along each opposing side to provide a locking surface 64 for securing the cover. In this regard, the lips 60 may extend inwardly toward the base and into the recesses to engage the locking surfaces and secure the cover to the base.

In one embodiment, the cover 46 may be formed with a sufficient amount of elasticity, flexibility and/or resilience which permits the side walls 58 and the lips 60 to be spread in an outward direction apart from each other to facilitate placement of the cover on the base. Following placement, the side walls may spring inwardly so that the lips 60 may engage the locking surfaces 64 of the recesses.

In one embodiment, the cover may employ a relatively rigid structure with insufficient elasticity to permit the side walls and lips to be flexed apart and spring back into position. In this embodiment, the cover may be slid on and/or off an end of the base with the lips sliding along the length of the recesses.

The cover and the base may be formed from any suitable material using any suitable fabrication technique as should be apparent to one of skill in the art. The cover and the base may be fabricated from metal, plastic or other suitable materials. For example, and without limitation, the cover and base may be formed from stainless steel, brass, bronze or other metals as should be apparent to one of skill in the art. In one embodiment, the cover may be fabricated from the same material as the latch housings to match texture and color. The base may be fabricated from the same material as the cover or a different material as should be apparent to one of skill. In one embodiment, the base may be fabricated from a metal to satisfy local fire and/or building codes. The cover and base may be fabricated by rolling, machining or extruding the material into a desired shape.

In one embodiment as shown in FIG. 4, the drive may be configured so that one end of the drive extends into the latch 24 and the opposite end of the drive extends into the actuator (not shown) in a similar manner. Such an arrangement may provide more appealing aesthetics for the exit device by concealing the ends of the drive. This arrangement may also restrict direct access to the drive rod and enhance the security of the exit device. For example, and without limitation, the opposing ends of the cover may be secured to the door or a portion of the latch or actuator to prevent the cover from being removed from the base without first detaching the ends of the cover.

For some applications, it may be desirable to configure the drive to have a low profile arrangement relative to a door panel. Such an arrangement may provide an aesthetically pleasing appearance which may facilitate blending into the surface of the door panel. Although illustrated in FIGS. 2 and 3 as being mountable to the outermost surface of a door panel, it is to be appreciated that the drive may be mountable within a recess or channel extending along the door panel. Such an arrangement may be desirable to further reduce the profile of the drive relative to the door panel.

In one embodiment illustrated in FIG. 6, the door panel 32 may include one or more elongated recesses or channels 80 with a size and/or configuration to receive each drive therein such that the drive may be at least partially recessed below the outermost surface of the door panel. As illustrated, the depth of the channel 80 may correspond with the height $H_1$ of the drive so that the cover 46 is positioned flush with the outmost surface of the door. It is to be appreciated, however, that the channel may be configured with any suitable depth so that the drive may be recessed below or project partially above the outermost surface of the door panel, as should be apparent to one of skill in the art.

In one embodiment, the door panel may include a channel 80 which extends from the first latch 24 to the second latch 26. In one embodiment, the door panel may include a first channel extending from the actuator 22 to the first latch 24 and a second channel extending from the actuator 22 to the second latch 26. The first drive 28 may be located within the first channel and the second drive 30 may be located within the second channel.

Figure 6:
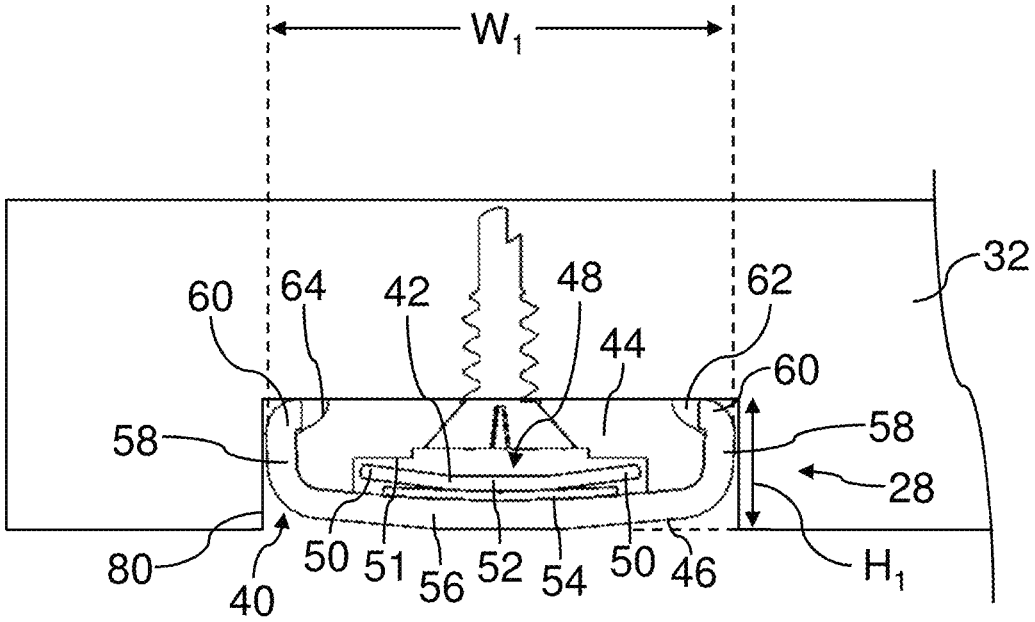
FIG. 6 is a cross-sectional view of the drive of the door exit device similar to FIG. 3 with the drive recessed within a channel on a door panel according to one embodiment.

As shown in FIGS. 3 and 6, the width of the drive may correspond to the width $W_1$ of the cover 46 and the height of the drive may correspond to the height $H_1$ of the cover. In one embodiment, the drive may have a width $W_1$ of about 1.0 inch and a height $H_1$ of about 0.28 inches. It is to be appreciated that the drive may be configured to employ any suitable profile size as should be apparent to one of skill in the art.

In one illustrative embodiment shown in FIG. 3, the rod may be formed by rolling or bending a relatively thin sheet of material into a low profile curved configuration. It is to be appreciated that the rod may employ any suitable configuration and be fabricated using any suitable process as should be apparent to one of skill in the art.

In one illustrative embodiment, the rod may be configured from a strip of relatively thin material to provide a lightweight, low profile structure with sufficient strength to transmit actuation forces from the actuator to the latches. In one embodiment, the rod may be formed from a sheet of spring steel having a thickness of 0.06 inches to 0.09 inches. Bending the material into the arcuate configuration enhances the strength of the rod against buckling, bending and/or twisting when subjected to and transmitting actuation forces. However, it is to be understood that the rod may employ any suitable configuration and be formed from any material as should be apparent to one of skill in the art. For example, and without limitation, the rod may be formed from a relatively thicker, flat sheet of material to provide the desired strength without bending the material.

In one illustrative embodiment, the base may have a width of about 0.87 inches and a height of about 0.19 inches. The channel may have a width of about 0.63 inches and a height of about 0.065 inches. The rod may have a width of about 0.6 inches in the channel. However, it is to be understood that these dimensions are exemplary and that the drive may be configured with components having any suitable dimensions as should be apparent to one of skill in the art.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A door exit device, comprising:

at least one latch configured to be mounted to a door panel, the at least one latch including a latch head movable between an engaged position and a disengaged position, the latch head configured to engage a strike plate in the engaged position;

an actuator configured to convert an actuation force applied thereto into a drive force to move the latch head in response to application of the actuation force, the actuator configured to be mounted to the door panel;

at least one drive configured to operatively couple the actuator to the at least one latch, the at least one drive including an elongated housing and an elongated rod, the housing configured to be mounted to an exterior surface the door panel and to slidably support the rod therein, the housing including a first end and a second end and having a length sufficient to position the first end at the actuator and to position the second end at the at least one latch, the rod configured to deliver the drive force from the actuator to the at least one latch, the rod including a first end configured to be coupled to the actuator and a second end configured to be coupled to the at least one latch, the rod is configured to be slid in a longitudinal direction, the rod having a maximum width and an arcuate configuration in a direction transverse to the longitudinal direction, the rod including a convex face to face away from the door panel and an open concave face to face toward the door panel, the rod including a first edge and a second edge defining the maximum width of the rod, the convex and concave faces extending between and terminating at the first and second edges, the entire concave face being open across the maximum width of the rod to face the door panel, the first and second edges extending from the first end of the rod to the second end of the rod, the first and second edges configured to slidably engage the housing.

2. The door exit device according to claim 1, wherein the housing includes a base configured to be mounted to the exterior surface of the door panel and a cover configured to overlie the base with the rod located between the cover and the base, the concave face is arranged to face the base and the convex face is arranged to face the cover.

3. The door exit device according to claim 2, wherein the base includes an elongated channel extending from a first end thereof to a second end thereof, the rod to be slidably supported within the channel.

4. The door exit device according to claim 2, wherein the housing includes a slide layer located between the convex face of the rod and the cover to reduce friction therebetween.

5. The door exit device according to claim 4, wherein the slide layer is attached to the cover.

6. The door exit device according to claim 2, wherein the cover is configured to snap onto the base.

7. A door comprising:

a door panel including a top end and a bottom end; and a surface vertical rod exit device mounted to the door panel, the surface vertical rod exit device including:

an upper latch mounted to the door panel in proximity to the top end thereof, the upper latch including an upper latch head movable between an engaged position and a disengaged position, the upper latch head configured to engage an upper strike plate in the engaged position;

a lower latch mounted to the door panel in proximity to the bottom end thereof, the lower latch including a lower latch head movable between an engaged position and a disengaged position, the lower latch head configured to engage a lower strike plate in the engaged position;

an actuator mounted to the door panel between the upper latch and the lower latch, the actuator being operative to move the upper latch head and the lower latch head in response to an actuation force being applied to the actuator, the actuator configured to convert the actuation force into a first drive force and a second drive force;

a first drive coupling the actuator to the upper latch, the first drive including a first housing, a first rod movably housed within the first housing and an elongated first cover concealing the first rod, the first housing mounted to an exterior surface of the door panel and extending from the actuator to the upper latch, the first rod coupling the actuator to the upper latch and configured to transmit the first drive force from the actuator to the upper latch, the first rod being movable in a longitudinal direction, the first rod having a length in the longitudinal direction and an arcuate configuration with a maximum width in a direction transverse to the longitudinal direction, the first rod including a convex face facing in a direction away from the exterior surface of the door panel and an open concave face facing in a direction toward the exterior surface of the door panel, the convex and concave faces extending between and terminating at opposing first and second edges which define the maximum width of the first rod and extend in the longitudinal direction, the entire concave face being open across the maximum width of the first rod and facing the exterior surface of the door panel, the elongated first cover concealing the length of the first rod extending from the actuator to the upper latch; and a second drive coupling the actuator to the lower latch, the second drive including a second housing, a second rod movably housed within the second housing and an elongated second cover concealing the second rod, the second housing mounted to the exterior surface of the door panel and extending from the actuator to the lower latch, the second rod coupling the actuator to the lower latch and configured to transmit the second drive force from the actuator to the lower latch, the second rod being movable in a longitudinal direction, the second rod having a length in the longitudinal direction and an arcuate configuration with a maximum width in a direction transverse to the longitudinal direction, the second rod including a convex face facing in a direction away from the exterior surface of the door panel and an open concave face facing in a direction toward the exterior surface of the door panel, the convex and concave faces extending between and terminating at opposing first and second edges which define the maximum width of the second rod and extend in the longitudinal direction, the entire concave face being open across the maximum width of the second rod and facing the exterior surface of the door panel, the elongated second cover concealing the length of the second rod extending from the actuator to the lower latch.

8. The door according to claim 7, wherein the first housing includes a first channel, the first rod being slidable along the first channel in response to application of the actuation force, the first cover overlying the first channel and the first rod, the first rod being slidably supported between the first channel and the first cover.

9. The door according to claim 8, wherein the second housing includes a second channel, the second rod being slidable along the second channel in response to application of the actuation force, second cover overlying the second channel and the second rod, the second rod being slidably supported between the second channel and the second cover.

10. The door according to claim 7, wherein each of the first and second rods is slidable in the longitudinal direction.

11. The door according to claim 7, wherein the door panel includes at least one elongated channel, each of the first drive and the second drive being located within the at least one elongated channel.

12. The door according to claim 11, wherein each of the first drive and the second drive is positioned flush with or recessed below an outermost surface of the door panel.

13. A surface vertical rod kit for a door surface vertical rod exit device which includes an actuator and at least one latch, the surface vertical rod kit comprising:

an elongated base configured to be mounted to an exterior surface of a door panel, the elongated base having a length sufficient to extend from a location of the door panel at or in close proximity to the actuator to a location of the door panel at or in close proximity to the at least one latch;

an elongated rod having a non-circular cross-sectional shape configured to be slidably supported by the base in a longitudinal direction, the rod including opposing first and second edges extending in the longitudinal direction and an open concave surface to face the base, the concave surface extending between and terminating at the first and second edges, the rod configured to transmit at least a portion of an actuation force from the actuator to the at least one latch; and a cover configured to enclose the base with the rod located therebetween, the cover configured to deflect the rod toward the base from a first height to a second height less than the first height and compress the first and second edges of the rod against the base.

14. The surface vertical rod kit according to claim 13, wherein the rod has a thickness and a width from the first edge to the second edge, the width being greater than the thickness.

15. The surface vertical rod kit according to claim 14, wherein the rod has an arcuate configuration extending in a direction from the first edge to the second edge.

16. The surface vertical rod kit according to claim 13, further comprising a slide layer configured to be located between the rod and the cover to reduce friction therebetween.

17. The surface vertical rod kit according to claim 16, wherein the slide layer is attached to the cover.

18. The surface vertical rod kit according to claim 13, wherein the cover is configured to snap onto the base.

19. The door exit device according to claim 2, wherein the rod is configured to be compressed between the base and the cover.

20. The door according to claim 7, wherein each of the first and second drives includes at least one slide layer located between the rod and the housing to reduce friction therebetween.

* * * * *